US006896578B2

(12) United States Patent
Shaw

(10) Patent No.: US 6,896,578 B2
(45) Date of Patent: May 24, 2005

(54) SWINGING BOB TOY WITH LIQUID-CONTAINING BOBS

(76) Inventor: Laurence J. Shaw, 338 Third Ave., #1, San Francisco, CA (US) 94118

( * ) Notice: Subject to any disclaimer, the term of this patent is extended or adjusted under 35 U.S.C. 154(b) by 0 days.

(21) Appl. No.: 10/922,022

(22) Filed: Aug. 19, 2004

(65) Prior Publication Data

US 2005/0048872 A1 Mar. 3, 2005

Related U.S. Application Data

(63) Continuation of application No. 10/732,611, filed on Dec. 10, 2003, now abandoned.
(60) Provisional application No. 60/433,262, filed on Dec. 12, 2002.

(51) Int. Cl.[7] ..... A63H 33/00
(52) U.S. Cl. ..... 446/490; 446/247; 446/267; 473/576
(58) Field of Search ..... 446/75, 247, 490, 446/235, 257; 473/575, 576, 423–428, 594

(56) References Cited

U.S. PATENT DOCUMENTS

| | | | | | |
|---|---|---|---|---|---|
| 93,249 | A | * | 8/1869 | Trebe | 473/571 |
| 213,642 | A | * | 3/1879 | Farnum | 446/490 |
| 672,099 | A | * | 4/1901 | Jackson | 473/576 |
| 1,241,000 | A | * | 9/1917 | Mulvey | 446/247 |
| 1,932,943 | A | * | 10/1933 | Smith | 446/247 |
| 2,161,154 | A | * | 6/1939 | Gertler | 446/253 |
| 3,605,327 | A | * | 9/1971 | Jones | 446/247 |
| 4,784,391 | A | * | 11/1988 | Herron | 273/109 |
| 4,878,868 | A | * | 11/1989 | Shaw | 446/75 |
| RE34,208 | E | * | 3/1993 | Shaw | 446/75 |
| 5,816,938 | A | | 10/1998 | Kakiuchi | 473/354 |
| 5,827,133 | A | | 10/1998 | Chang | 473/370 |
| 5,984,805 | A | | 11/1999 | Maruko | 473/354 |
| 6,238,304 | B1 | | 5/2001 | Scolamiero et al. | 473/354 |
| 6,299,550 | B1 | | 10/2001 | Molitor et al. | 473/354 |
| 6,435,985 | B1 | | 8/2002 | Sullivan et al. | 473/377 |

OTHER PUBLICATIONS

Van Nostrand's Scientific Encyclopedia, Fifth Edition, Edited by D.M. Considie, Van Nostrand Reinhold Co., New York, 1976 pp. 1074–1076.

The Feynman Lectures on Physics, vol. II, R.P. Feynman, R.B. Leighton, and M. Sands, Addison–Wesley Publishing Co., Reading Massachusetts, 1964. Chapters 40 and 41.

Fluid Mechanics, L.D. Landau and E.M. Lifshitz, Pergamon Press, Oxford, England 1959. Sections 1, 2, 5, 7, 8, 9, 10, 11, 15, 16, 19, 20, 21, 26, 27, 31 and 32.

* cited by examiner

*Primary Examiner*—Bena B. Miller
(74) *Attorney, Agent, or Firm*—Integral Patent Associates

(57) ABSTRACT

A swinging bob toy having an outer bob and middle bob on a string, with the middle bob having a bore through which the string passes to allow the middle bob to slide along the string. The middle bob has a substantially toroidal, liquid-containing bladder. The mass of the liquid contributes substantially to the overall mass of the middle bob, but the viscosity of the liquid and the dimensions of the bore of the toroid are such that the dynamic moment of inertia (i.e., a moment of inertia dependent on linear and/or rotational velocity and/or acceleration, of a history thereof) is small as the middle bob begins its rotation as the outer bob passes the top of its orbit. The viscosity of the liquid is small enough that as the outer bob traverses the top of its orbit the dynamic moment of inertia is small and the string does not tangle about the middle bob, yet large enough that as the outer bob traverses the bottom of its orbit the rotation of the middle bob is slowed and the string tension does not exhibit a rapid peak.

30 Claims, 9 Drawing Sheets

SWINGING BOB TOY WITH LIQUID-CONTAINING BOBS

CROSS-REFERENCE TO RELATED APPLICATIONS

The present application is a continuation of and claims the benefit of the filing date of prior-filed nonprovisional patent application Ser. No. 10/732,611, filed Dec. 10, 2003 now abandoned, by the same inventor and having the same title as the present application, which is in turn based on and claims the benefit of the filing date of prior-filed provisional patent application Ser. No. 60/433,262, filed Dec. 12, 2002, by the same inventor and having the title "Swinging bob toy with liquid-filled bobs."

BACKGROUND OF THE INVENTION

The present invention is directed to swinging bob toys with a sliding middle bob having a low moment of inertia about an axis perpendicular to the bore axis of the middle bob, and more particularly to swinging bob toys with a sliding middle bob having a low transient moment of inertia about an axis perpendicular to the bore axis of the middle bob due to movable components within the middle bob.

As shown in FIG. 1A, a swinging bob toy (200) consists of three bobs (210), (211) and (212) on a string (220), with the end bobs (210) and (212) constrained at the ends (221) and (222) of the string (220), and the middle bob (211) having a bore (230) through which the string (220) passes, thereby allowing the middle bob (211) to slide along the string (220). The end bobs (210) and (212) are fixed on the string (220) at the ends (221) and (222) thereof by pins (205) and (not visible in FIG. 1A) lodged into the bores of the end bobs (210) and (212), respectively. (Alternatively, the bobs (210) and (212) may be constrained on the string (220) by knots at each end (221) and (222) of the string (220) having diameters larger than the bores of the end bobs (210) and (212), respectively.) As shown in FIG. 2A, the toy (200) is operated by holding an end bob (212), and oscillating the hand (141) to cause the other two bobs (210) and (211) to separate and the end bob (210) to orbit about the middle bob (211). The bobs (210) and (211) can describe a vertical orbit (290), as shown in FIG. 2A, or horizontal orbits, figure-eight type orbits or irregular paths. Having a bob (210)/(212) at each end (221)/(222) of the string (220) allows a player to hold either end bob (210)/(212) during operation and perform juggling tricks, such as switching end bobs (210)/(212) in mid-air.

As discussed in U.S. Pat. No. Re. 34,208 (column 3, lines 32–57), high-speed photography shows that for a swinging bob toy (200) with a middle bob (211) having a low moment of inertia, the rotation of the middle bob (211) has two different modes of motion as the end bob (210) passes by the string (220) at the top of its orbit, i.e., when the end bob (210) performs its "string pass."

In a first mode of motion, the bore axis (235) of the middle bob (211) rotates to roughly follow the path of the swinging end bob (210) as it (210) describes the lower half (292) of its orbit (290), as is indicated by the clockwise arrow next to the middle bob (211) in FIG. 4A. But as the swinging end bob (210) begins the upper half (291) of its orbit (290), the rotation of the middle bob (211) slows and stops, as indicated by the lack of an arrow next to the middle bob (211) in FIG. 4B. Then, during the upper half (291) of the orbit (290) of the swinging end bob (210), the middle bob (211) reverses its direction of rotation, as is indicated by the counter-clockwise arrow next to the middle bob (211) in FIG. 4C. As the swinging end bob (210) continues its descent, the middle bob (211) completes a roughly 180° rotation (which according to the lexography of the present specification will be termed the 180° string pass rotation), and the bore axis (235) is roughly horizontal and points towards the side of the orbit (290) where the swinging end bob (210) is currently descending, as is shown in FIG. 4D.

In a second mode of motion, the bore axis (235) of the middle bob (211) rotates to roughly follows the path of the swinging end bob (210) as it (210) describes the lower half (292) of its orbit (290), as is indicated by the clockwise arrow next to the middle bob (211) in FIG. SA. As the swinging end bob (210) begins the upper half (291) of its orbit (290), the rotation of the middle bob (211) slows and stops, as indicated by the lack of an arrow next to the middle bob (211) in FIG. 5B. Then, during the upper half (291) of the orbit (290) of the swinging end bob (210), the middle bob (211) rotates in the horizontal plane to the side of the string (220) on which the outer bob (210) will pass, as is indicated by the arrow next to the middle bob (211) in FIG. 5C. As the swinging end bob (210) continues its descent, the middle bob (211) completes a roughly 180° rotation in the horizontal plane (i.e., its 180° string pass rotation), and again the bore axis (235) is roughly horizontal and points towards the side of the orbit (290) where the swinging end bob (210) is currently descending, as is shown in FIG. 5D.

Hybrid motions of the middle bob (211), combining or alternating between the first and second modes of motion, are also possible. For instance, in the course of its (211) rotation during the string pass, the middle bob (211) may begin to rotate counter-clockwise in the vertical plane, then rotate in the horizontal plane, and then rotate counter-clockwise again in the vertical plane. Or the middle bob (211) may rotate around an axis that is mid-way between the vertical and horizontal planes.

As shown in the cut-away view of the middle bob (211) of FIG. 3A and the cross-sectional view of FIG. 3B, one of the innovations of the swinging bob toy (200) of U.S. Pat. No. Re. 34,208 is a high-density weight (240) centered within a low-density surrounding material (250). In a swinging bob toy marketed under the trademark AstroJax®, and having been distributed by New Toy Classics of San Francisco, Calif., United States, the weight (240) is made of brass and is essentially cylindrical with a central bore (232) along the axis of cylindrical symmetry (235) (i.e., the "polar axis") of the bob (211). The material (250) surrounding the weight (240) is a soft foam having a density of roughly 0.4 g/cc. The exterior surface (251) of the foam bob (211) is spherical, with the exception of two conical-section indents (231) at the top and bottom which lead to the weight (240). The bore (230) of the bob (211) consists of the conical indents (231) in combination with the bore (232) of the weight (240). The mouth (234) of each conical-section indent (231) is rounded to meet the outside spherical surface (251).

The function of the high-density weight (240) is to concentrate the mass near the center of the bob (211), providing a low moment of inertia I about axes perpendicular to the polar axis (235), thereby allowing the middle bob (211) to rotate rapidly as the swinging outer bob (210) traverses the top (291) of its orbit (290). This is the same principle that a diver uses when she tucks into a ball during a dive to complete more rotations, or an ice skater uses when he brings in his arms during a spin to rotate faster.

The moment of inertia I of a middle bob (211) about an axis of rotation (299) in the equatorial plane (237) is given by $$I=\int \rho r^2 d\tau, \tag{1.1}$$

where ρ is density, r is distance from the axis of rotation (299), dτ is an infinitesimal volume element, and the integration is performed over volume. (The "moment of inertia"

according to the lexography of the present invention is sometime referred to in other literature as the "radius of gyration.") The dependence of the moment of inertia I on the second power of the distance r from the axis of rotation (299) is somewhat non-intuitive since non-rotational dynamics does not have any relevant quantities with a similar radius-squared weighting. For instance, for a homogeneous ball of radius R, the inner half contributes about 3% to the total moment of inertia, while the outer half contributes about 97% to the total moment of inertia.

As discussed in U.S. Pat. No. Re. 34,208, a crucial measure of the goodness of operation of a swinging bob toy (200) is the dimensionless operation ratio X given by $$X=(m\ h^2/I)^{1/2} \tag{1.2}$$

where m is the mass of a bob (210)/(211)/(212), and h is the height of the bore (230). If the operation ratio X is much greater than unity, the middle bob (211) can rotate rapidly in response to torques produced by the string (220), and so the string (220) will not snag around the middle bob (211) during the string pass and the motion will be smooth. However, if the operation ratio X is much less than unity, the middle bob (211) cannot rotate rapidly in response to torques produced by the string (220), and so the string (220) will tend to snag, or even tangle, around the middle bob (211) during the string pass, disrupting the orbital motions of the bobs (210) and (211) and inhibiting enjoyment of the toy (200).

Active People of Benningen, Switzerland and a growing number of other toy companies are producing swinging bob toys which utilize a metal weight to lower the moment of inertia. Unfortunately, the limited ranges in the densities of solid low-density and high-density materials limits the degree to which the operation ratio X can be maximized, and ways in which the middle bob may be constructed. Furthermore, the inclusion of a metal weight contributes substantially to the cost of the toy.

It is an object of the present invention is to provide a swinging bob toy which operates smoothly, i.e., a swinging bob toy where the string does not tend to tangle around the middle bob, and the string tension does not have spikes, jumps, or vary rapidly.

It is another object of the present invention to provide a swinging bob toy having a middle bob with a small moment of inertia and a large operation ratio.

It is another object of the present invention is to provide a swinging bob toy having a middle bob which does not incorporate a high-density, centrally-positioned weight yet still has a small moment of inertia and a large operation ratio.

It is another object of the present invention is to provide a swinging bob toy with a dynamic moment of inertia, i.e., a moment of inertia which is time-dependent, velocity-dependent, acceleration-dependent, or dependent on a history of the motion of the middle bob.

It is another object of the present invention is to provide a swinging bob toy with a dynamic operation ratio, i.e., a goodness of operation ratio which is time-dependent, velocity-dependent, acceleration-dependent, or dependent on a history of the motion of the middle bob.

It is another object of the present invention is to provide a swinging bob toy with a middle bob having movable components to produce a small moment of inertia and a large operation ratio.

It is another object of the present invention is to provide a swinging bob toy with a middle bob having a liquid-containing bladder to produce a small moment of inertia and a large operation ratio.

It is another object of the present invention is to provide a swinging bob toy with a middle bob having a bladder containing one or more liquids, where the density and viscosity of the liquid and the geometry of the bladder produce a small moment of inertia and a large operation ratio.

Furthermore, as motivated and explained in detail below, it is an object of the present invention to provide a swinging bob toy having a middle bob with a liquid-containing bladder where the liquid has a viscosity which is large enough that the operation is smooth as the orbiting outer bob enters the bottom of its orbit.

Additional objects and advantages of the invention will be set forth in the description which follows, and will be apparent from the description or may be learned from the practice of the invention. The objects and advantages of the invention may be realized and obtained by means of the instrumentalities and combinations particularly pointed out in the claims.

SUMMARY OF THE PRESENT INVENTION

The present invention is directed to a swinging bob toy having a first bob and a sliding bob on a string. The sliding bob has a bore through which the string passes, allowing the sliding bob to slide along the string. The sliding bob includes a bladder encircling said bore which contains a liquid.

BRIEF DESCRIPTION OF THE FIGURES

The accompanying figures, which are incorporated in and form a part of this specification, illustrate embodiments of the invention and, together with the description given above and the detailed description of the preferred embodiments given below, serve to explain the principles of the invention.

DETAILED DESCRIPTION OF THE PREFERRED EMBODIMENTS

Figure 1A:
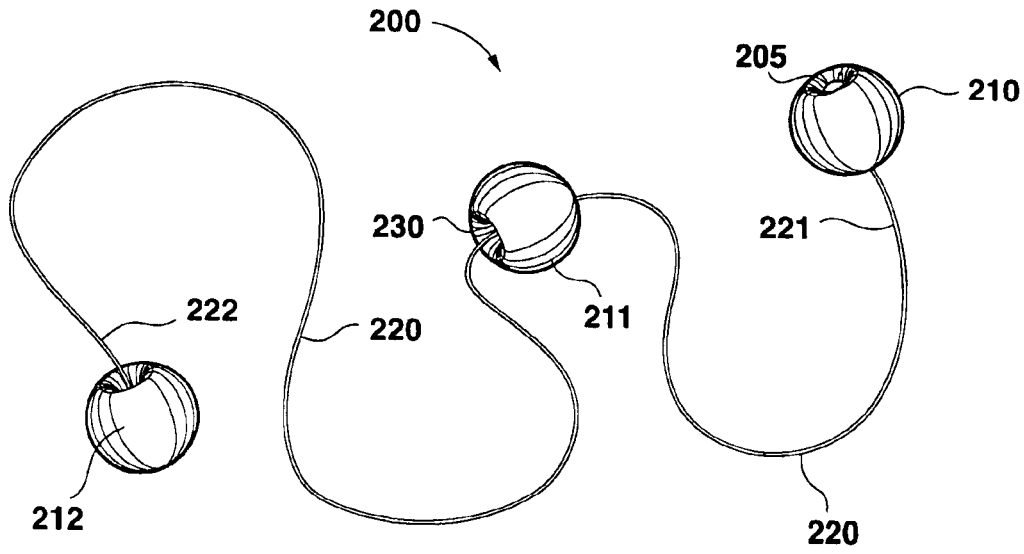
FIG. 1A (PRIOR ART)
FIG. 1A shows a swinging bob toy according to the prior art.
Figure 1B:
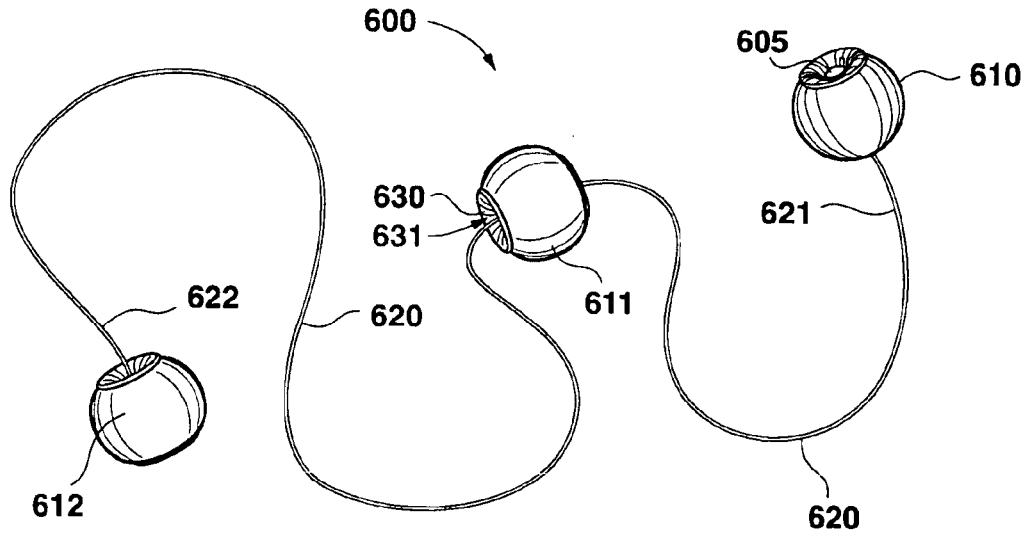
FIG. 1B shows a swinging bob toy according to the present invention.
Figure 2A:
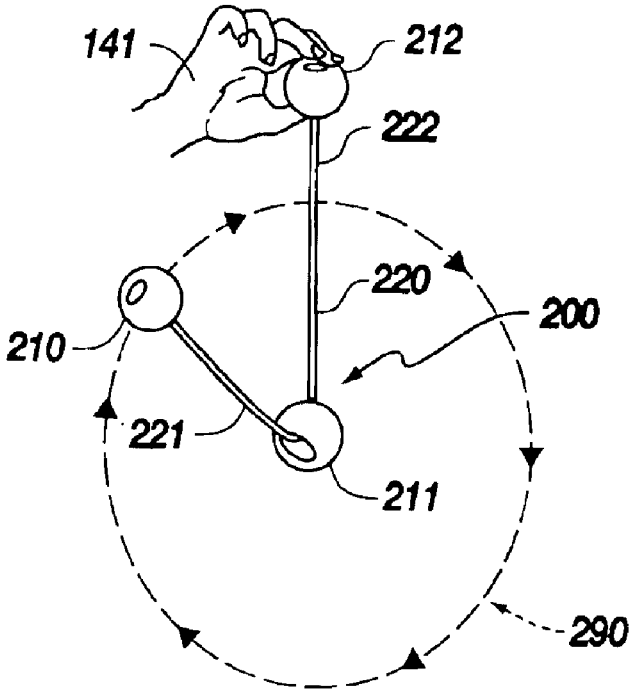
FIG. 2A (PRIOR ART)
FIG. 2A shows operation of the swinging bob toy of FIG. 1 with the orbiting outer bob describing a vertical orbit.
Figure 2B:
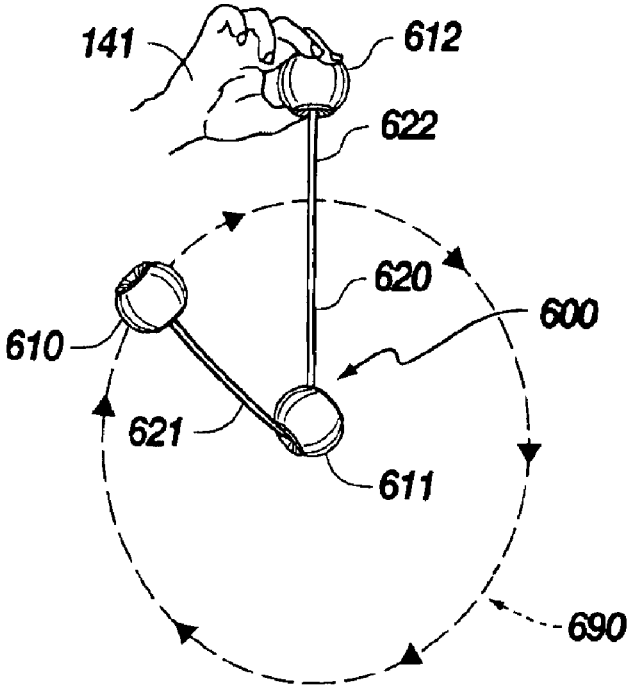
FIG. 2B shows operation of the swinging bob toy of FIG. 1A with the orbiting outer bob describing a vertical orbit.
Figure 3A:
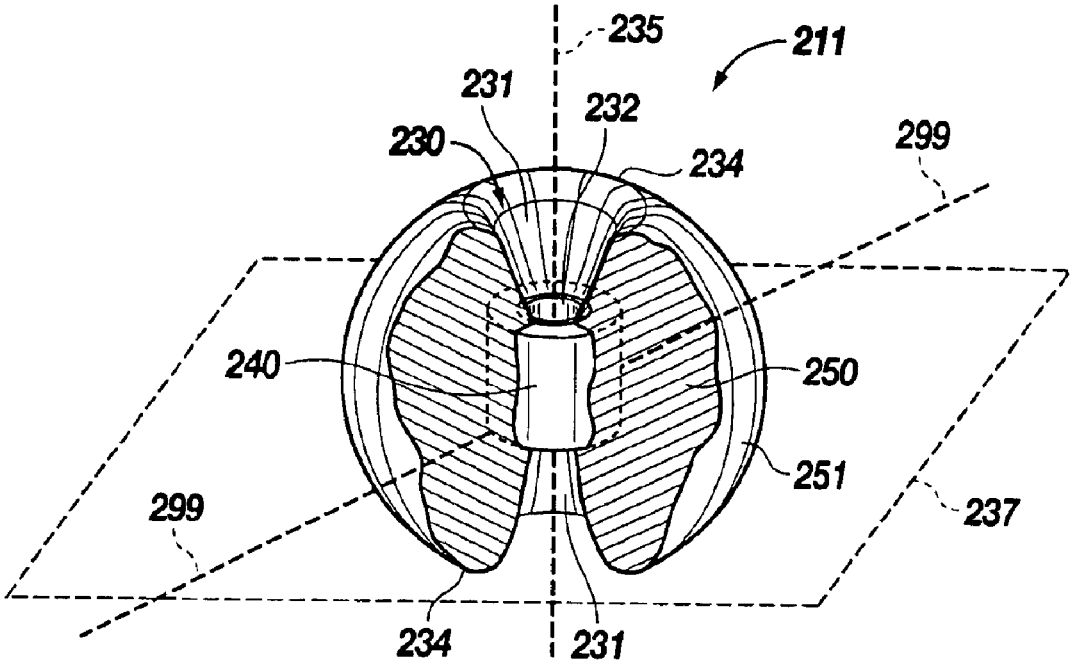
FIG. 3A (PRIOR ART)
FIG. 3A shows a cut-away view of a middle bob having a mass distribution as described in the prior art, i.e. having a high density central weight inside a low-density material.
Figure 3B:
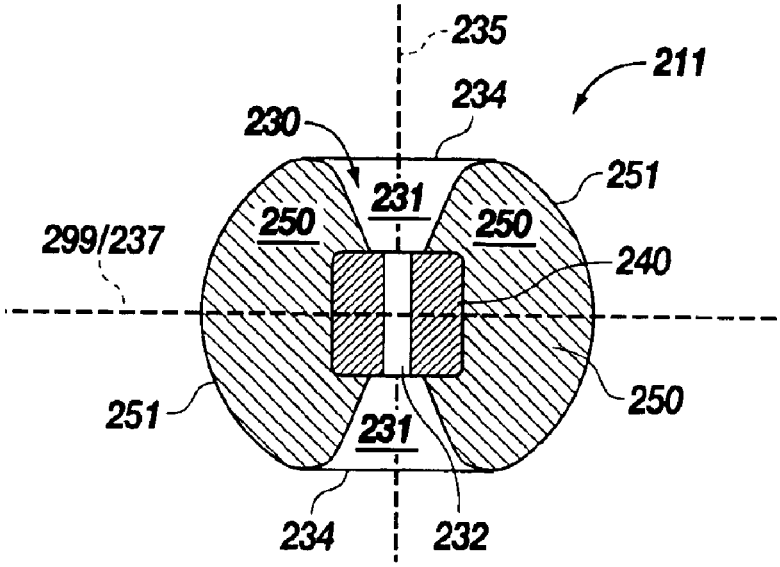
FIG. 3B (PRIOR ART)
FIG. 3B shows a cross-sectional view of the middle bob of FIG. 3A.

A swinging bob toy (600) according to the present invention is shown in FIG. 1B. As is the case with the swinging bob toy (200) of the prior art depicted in FIG. 1A, the swinging bob toy (600) of the present invention consists of three bobs (610), (611) and (612) on a string (620), with the middle bob (611) having a bore (632) through which the string (620) passes, thereby allowing the middle bob (611) to slide along the string (620). The end bobs (610) and (612) are fixed on the string (620) at the ends (621) and (622) thereof by pins (605) and (not visible in FIG. 1A) lodged into the bores of the end bobs (610) and (612), respectively. Alternatively, the bobs (210) and (212) may be constrained on the string (220) by knots at each end (221) and (222) of the string (220) having diameters larger than the bores of the end bobs (210) and (212), respectively. As shown in FIG. 2B, the toy (600) is operated by holding an end bob (612), and oscillating the hand (141) to cause the other two bobs (610) and (611) to separate and the orbiting end bob (610) to orbit about the middle bob (611). The bobs (610) and (611) can describe a vertical orbit (690), as shown in FIG. 2B, or horizontal orbits, figure-eight type orbits or irregular paths.

Figure 6A:
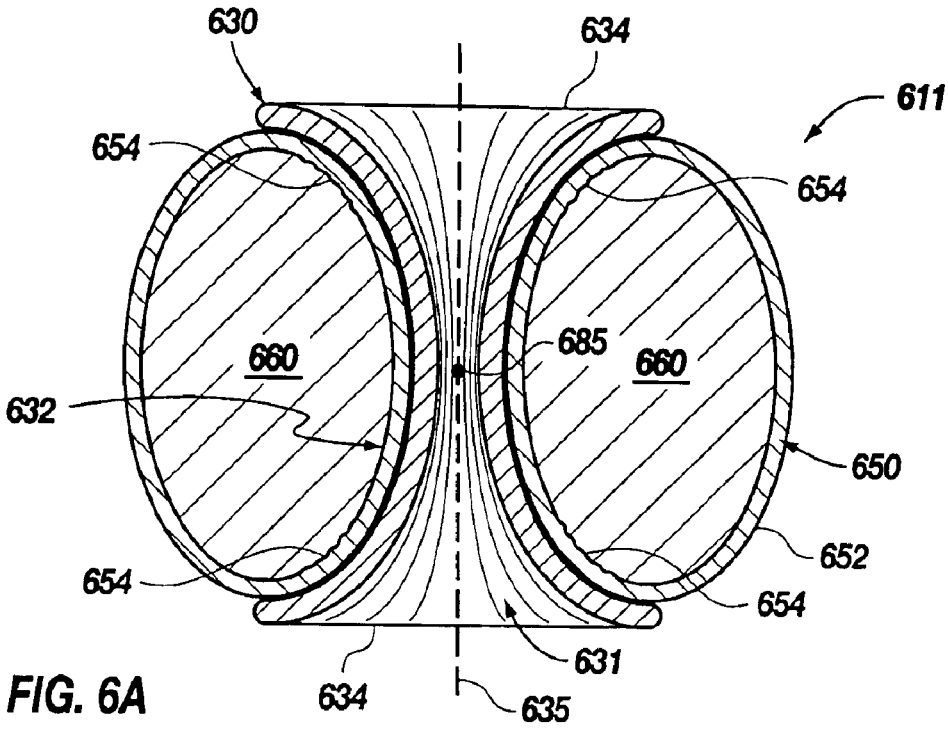
FIG. 6A shows a cross-sectional view of a middle bob having a bladder which contains a liquid.
Figure 6B:
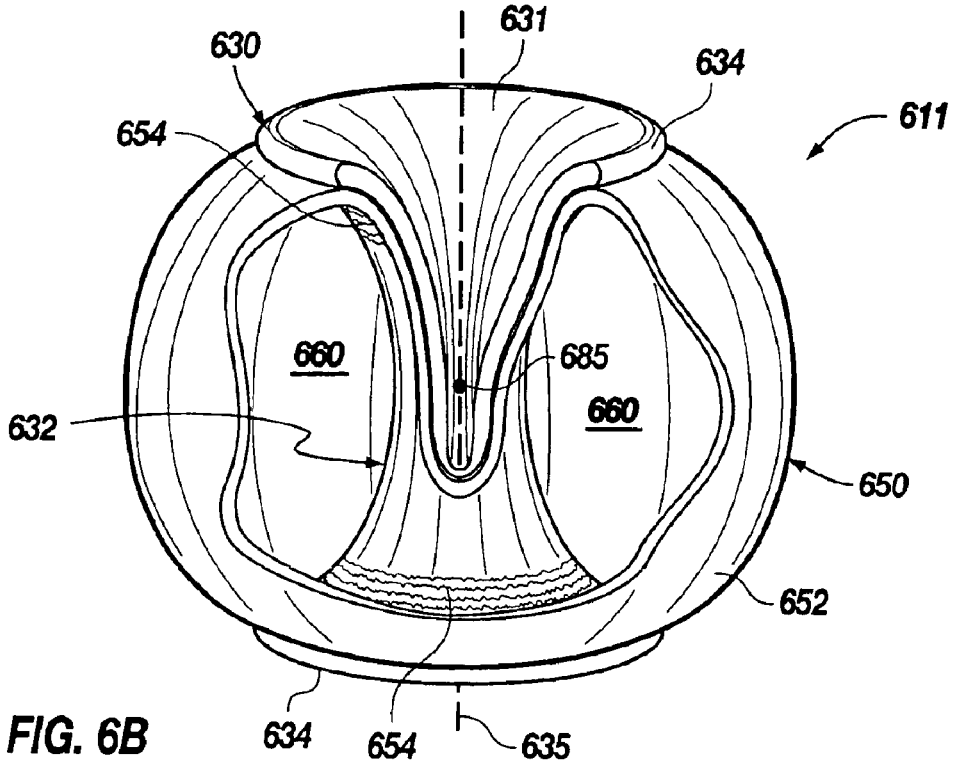
FIG. 6B shows a cut-away view of the middle bob of FIG. 6A.

The difference between the swinging bob toy (200) of the prior art and the swinging bob toy (600) of the present invention is that each of the bobs (610), (611) and (612) of the swinging bob toy (600) of the present invention has a liquid bladder. FIGS. 6A and 6B show a cross-sectional view and a cut-away view, respectively, of a middle bob (611) according to the present invention having a substantially-toroidal bladder (650) which contains a liquid (660). According to the preferred embodiment of the present invention, the bladder (650) is made of an elastomeric material, such as a rubber or flexible plastic, having a thickness of approximately 2 mm. The bore region (632) of the bladder (650) is the region between the top and bottom edges of the bladder (650) from which the liquid (660) is excluded. Within the bore region (632) of the bladder (650) is a close-fitting sheath (630) which extends to at least the upper and lower (according to the orientation shown in FIGS. 6A and 6B) edges of the central aperture of the bladder (650), and which has a throughbore (631) through which the string (620) passes. (It should be noted that according to the lexography of the present specification a differentiation is made between the throughbore (631) and the bore region (632).) The sheath (630) is stiff and has a low coefficient of sliding friction with the string (620). The exposed surface of the bladder (650) (i.e., the outer surface of the bladder (650) not in contact with the sheath (630)) is substantially spherical.

(According to the lexography of the present specification, when an object is said to "substantially" have a particular quality it is meant that in categorizing that object with regards to the category of qualities of that type, that particular quality would be considered to be most applicable to the object. For instance, in saying that the outer surface of the bladder (650) is "substantially spherical," the category of qualities of that type is geometric shapes, and the category would include qualities such as flat, square, cubic, ellipsoidal, toroidal, conical, pyramidal, etc. Furthermore, when a quantity is said to "approximately" have a particular numerical value it is meant that the quantity has that particular numerical value to within several per cent.)

As is apparent from FIGS. 6A and 6B, the throughbore (631) through the sheath (630) is wider at its mouth (634) than at its midpoint (685). In the preferred embodiment of the present invention, the bladder (650) has an equatorial diameter of 4.0 cm, the throughbore (631) of the sheath (630) has a width at its midpoint (685) of 0.3 cm and a width at the apex of the mouth (634) of 1.8 cm. The liquid (660) in the bladder (650) has a mass of around 33 grams, and the bladder (650) and sheath (630) has a mass of around 17 grams.

A crucial measure of the goodness of operation of the middle bob of the swinging bob toy (600) is the dimensionless operation ratio X given by $$X=(m\,h^2/I)^{1/2}, \tag{1.2}$$

where I is a moment of inertia about axes perpendicular to the polar axis (635), m is the mass of each bob, and h is the height of the throughbore (631). However, it is important to note that equations (1.1) and (1.2) assume that the components of the middle bob (311) are solid and fixed in position relative to each other. In other words, I is a static moment of inertia, and X is therefore a static operation ratio. However, for the swinging bob toy (600) of the present invention, where the middle bob (611) includes movable components, such as a liquid (660), the quantity of relevance is a dynamic operation ratio X* given by $$X^*=(m\,h^2/I^*)^{1/2} \tag{2.1}$$

where I* is a dynamic moment of inertia, i.e., a moment of inertia which is dependent on the linear and/or rotational velocity and/or acceleration, or a history of the linear and/or rotational velocity and/or acceleration. According to the lexography of the present specification in its description of the present invention, the non-dynamic moment of inertia $\bar{I}^*$ is defined as the moment of inertia when the movable components of the middle bob (611), such as any liquid regions, are frozen in place relative to each other and the non-movable components of the bob (611).

The dynamic moment of inertia I* of the middle bob (611) at any instant is determined empirically according to $$\Gamma=I^*\dot{\omega} \tag{2.2}$$

where Γ is the torque produced by the string (620) on the middle bob (611), ω is rotational velocity, and $\dot{\omega}$ is the rotational acceleration. If the force is applied to the bore (632) at only a single point, then the dynamic moment of inertia I* is given by $$I^*=F_D r \sin\theta/\dot{\omega} \tag{2.3a}$$

where $F_D$ is the drag force resisting the rotation of the middle bob (611) (which is also the applied force), r is the moment arm (i.e., the distance from the center of mass of the middle bob (611) to the point of contact of the applied force $F_D$), and θ is the angle between the applied force $F_D$ and the vector direction of the moment arm r. More generally, when the string (620) makes contact with the throughbore (631)

with contact force $F^{(i)}$ at a number n of points i along the throughbore (631), then $$I^* = \frac{1}{\dot{\omega}}\sum_{i=1}^{n} F^{(i)} r^{(i)} \sin\theta^{(i)}, \tag{2.3b}$$

where $\theta^{(i)}$ is the angle between the direction of the contact force $F^{(i)}$ and the direction of the moment arm $r^{(i)}$. Typically, the drag force $F_D$ resisting the rotation of the middle bob (611) is considered to be dependent on the viscosity ν of the liquid (660), the specific gravity ρ of the liquid (660), the rotational velocity ω of the middle bob (611), the rotational acceleration $\dot{\omega}$ of the middle bob (611), and the particulars of the geometry of the bladder (650). However, more generally the drag force $F_D$ resisting the rotation of the middle bob (611) is also dependent on other factors, such as the linear velocity and acceleration, or the history of the linear and/or rotational velocity and/or acceleration of the middle bob (611).

Figure 7A:
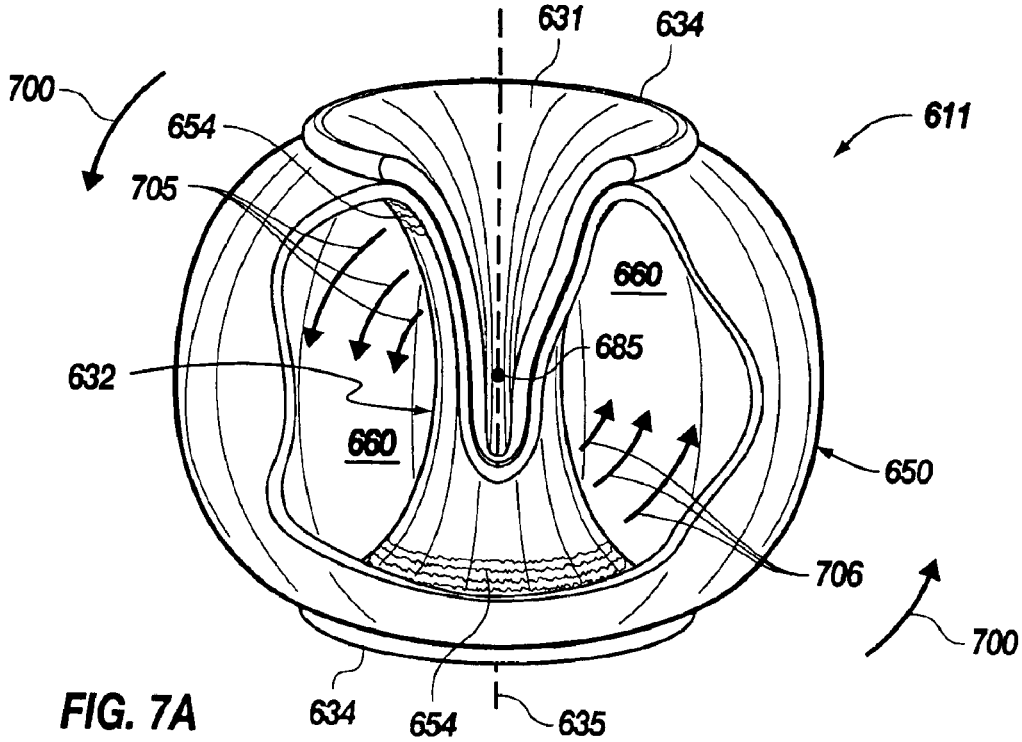
FIG. 7A shows fluid motion during a bob rotation about an axis perpendicular to the bore axis that produces a non-dynamic moment of inertia.
Figure 7B:
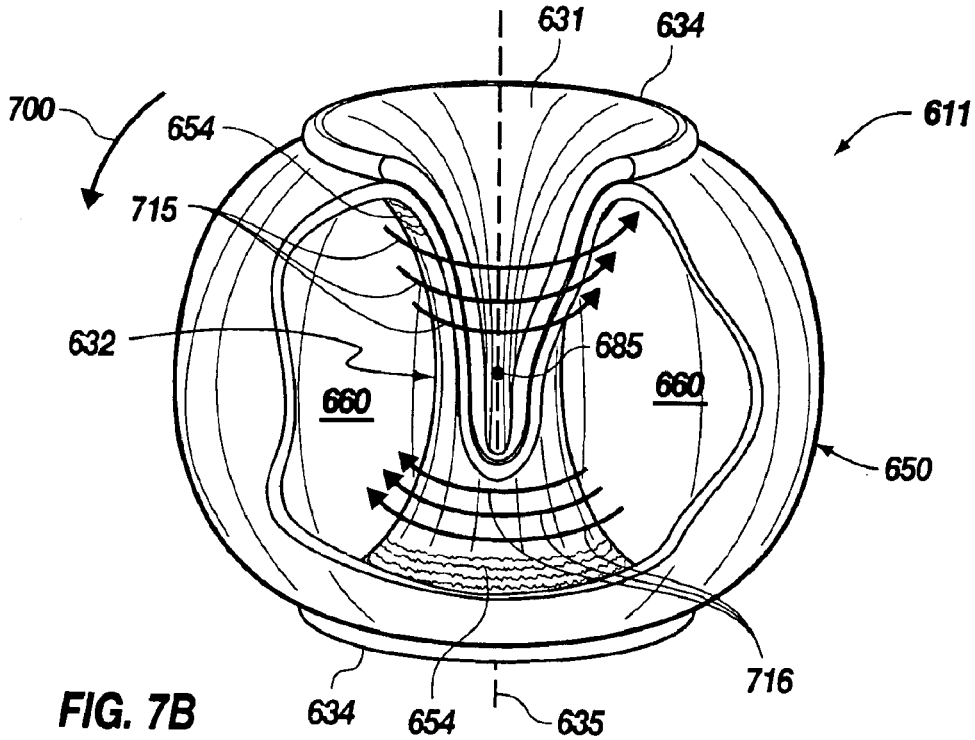
FIG. 7B shows fluid flow past the bore during a bob rotation about an axis perpendicular to the bore axis that produces a dynamic moment of inertia which is generally smaller than the non-dynamic moment of inertia corresponding to the fluid motion shown in FIG. 7A.

The difference in the motion of component parts of the liquid-filled bob (611) of the present invention for a moment of inertia which is predominantly dynamic versus a moment of inertia which is predominantly non-dynamic is illustrated in FIGS. 7A and 7B. In FIGS. 7A and 7B, the arrow (700) to the outside of the bladder (650) indicates that the bladder (650) is rotationally accelerated in the counter-clockwise direction. In FIG. 7A, the counter-clockwise arrows (705) and (706) within the bladder (650) indicate that for a bore region (632) which is wide, or a liquid (660) of very high viscosity ν (or a solid material) within the bladder (650), the material (660) within the bladder (650) rotates with the bladder (650). In this case, the rotational kinematics are adequately described by the standard moment of inertia I calculated according to equation (1.1). In contrast, FIG. 7B depicts fluid trajectories for a bore region (632) which is narrow and a liquid (660) within the bladder (650) which has a viscosity ν which is very low. In particular, as shown in FIG. 7B, the arrows (715) in the upper half of the bob (611) point from the left half of the bob (611) to the right half, and the arrows (715) in the lower half of the bob (611) point from the right half of the bob (611) to the left half, indicating that the liquid (660) in the top, left quarter will travel around the bore region (632) to the right, and the liquid (660) in the lower, right quarter will travel around the bore region (632) to the left, thereby providing considerably less resistance to a rotation of the bladder (650) in a direction perpendicular to the bore axis (635). (The arrows (715) and (716) depict the motion of liquid (660) in the half of the bob (611) closest to the viewer, and therefore the liquid (660) passes by the bore region (632) on the side closer to the viewer. Correspondingly, the liquid (660) in the half of the bob (611) on the side away from the viewer passes by the bore region (632) on the side farther from the viewer.) In addition, for a bore region (632) which is narrow and a liquid (660) within the bladder (650) which has a very low viscosity ν, the portions of the liquid (660) away from the region in space through which the bore region (632) passes remain relatively stationary as the bladder (650) rotates about an axis perpendicular to the throughbore (631), thereby also contributing substantially to the reduction in the resistance to a rotation of the bladder (650). (It should be noted that, in general, the motion of a liquid (660) within the bladder (650) will be described by some combination of the trajectories (705), (706), (715) and (716) shown in FIGS. 7A and 7B, or by more complicated trajectories.)

It should also be noted that for a constant velocity of rotation of the bob (611), the liquid will eventually become stationary relative to the rotating frame of reference of the rotating bob (611). That is, for bobs having movable components, the dynamic moment of inertia I* is a transient quantity which is relevant in discussions of non-zero rotational accelerations, i.e., a non-constant rotational velocity. For the swinging bob toy (600) of the present invention, a substantial rotational acceleration of the middle bob (611) occurs during the 180° string pass rotation. According to the lexography of the present specification in its description of the present invention, "non-movable" components of a bob (610), (611) or (612) are those portions of the bob (610), (611) or (612) which are stationary relative to the bore axis (635) and its center point (685) when the bob (610), (611) or (612) is linearly or rotationally accelerated. Similarly, "movable" components of a bob (610), (611) or (612) are those portions of the bob (610), (611) or (612) which are not stationary relative to the bore axis (635) and its center point (685) when the bob (610), (611) or (612) is linearly or rotationally accelerated.

The dynamic moment of inertia I* of a bob (611) with movable components (such as the liquid-containing middle bob (611) of FIGS. 6A and 6B) at any instant is equal to the sum of the static moment of inertia $I_s$ of the non-movable components (i.e., the bladder (650) and sheath (630)) plus the dynamic moment of inertia $I_q^*$ of the movable components (i.e., the liquid (660)). That is $$I^* = I_s + I_q^* \tag{2.4}$$

According to the present invention, the sum of the static moment of inertia $I_s$ of the non-movable components and a dynamic moment of inertia $I_q^*$ of the movable components is substantially smaller than the sum of the static moment of inertia $I_s$ of the non-movable components and the non-dynamic moment of inertia $\bar{I}_q^*$ of the movable components, i.e., $$I_s + I_q^* << I_s + \bar{I}_q^*, \tag{2.5}$$

In particular, according to the preferred embodiment of the present invention, the sum of the static moment of inertia $I_s$ of the non-movable components and a dynamic moment of inertia $I_q^*$ of the movable components is less than the sum of the static moment of inertia $I_s$ of the non-movable components and the non-dynamic moment of inertia $\bar{I}_q^*$ of the movable components, more preferrably less than 80%, more preferrably less than 70%, more preferrably less than 60%, more preferrably less than 50%, more preferrably less than 40%, more preferrably less than 30%, more preferrably less than 20%, and still more preferrably less than 10% of the sum of the static moment of inertia $I_s$ of the non-movable components and non-dynamic moment of inertia $\bar{I}_q^*$ of the movable components. Furthermore, according to the present invention, the mass $M_s$ of the non-movable components is substantially smaller than the mass $M_q$ of the movable components, i.e., $$M_s << M_q \tag{2.6}$$

According to the present invention, the mass $M_s$ of the non-movable components is less than the mass $M_q$ of the movable components, more preferrably less than 80%, more preferrably less than 70%, more preferrably less than 60%, more preferrably less than 50%, more preferrably less than 40%, more preferrably less than 30%, more preferrably less than 20%, and still more preferrably less than 10% of the mass $M_q$ of the movable components.

According to the preferred embodiment, the viscosity ν of the liquid (660) is small enough and the bore region (632) is narrow enough that a substantial portion of the liquid (660) in the region through which the bore region (632) passes flows around the bore region (632), as depicted in FIG. 7B, and a substantial portion of the liquid in the region outside of the region through which the bore passes remains relatively stationary rather than being rotated with the bore region (632) as depicted in FIG. 7A. According to a first preferred embodiment, the liquid (660) within the bladder (650) is water. At room temperature, water has a viscosity of approximately 0.01 poise.

However, below 0° C. the dynamic properties of the moment of inertia will be lost if the liquid (660) is pure water. Therefore, according to the present invention, an anti-freezing agent, such as salt, is mixed with the water (660) within the middle bob (611). The freezing point of water is depressed by approximately 18.5° C. for each gram molecular weight of salt dissolved in a gram of water. Therefore, the addition of one gram molecular weight of salt per gram of water (660) in the bob (611) is sufficient to provide playability of the toy (600) over a reasonable range of temperatures.

In analyzing fluid flow it is useful to consider the dimensionless Reynolds number $R_e$ and dimensionless Mach number M. The Mach number M is defined as equal to (V/c), where V is a representative velocity and c is the speed of sound. For Mach numbers M considerably less than unity, the liquid (660) can be regarded to be incompressible. The Reynolds number $R_e$ is defined as equal to (VD/ν), where D is a characteristic width, and ν is the specific viscosity. For flow conditions having a Reynolds number $R_e$ less than around 100, the flow is non-turbulent. For flow conditions having a Reynolds number $R_e$ greater than around 100, the flow is turbulent. According to the preferred embodiment, the middle bob (611) has a diameter of 4.0 cm, the bore region (632) flares from a diameter of about 0.4 cm at its center (685) to a diameter of almost 2.0 cm at the mouth (634) of the bore region (632), and it is observed empirically that the middle bob (611) will typically complete the 180° string pass rotation in about $1/30^{th}$ of a second. Therefore, the Reynolds number $R_e$ reaches a value on the order of $6\times10^4$ at the mouth (634) of the bob (611). Since the speed of sound in water at 20° C. and one atmosphere pressure is about $1.5\times10^5$ cm/sec, the Mach number M is on the order of $10^{-3}$, and the liquid (660) can be assumed to be incompressible.

Figure 9:
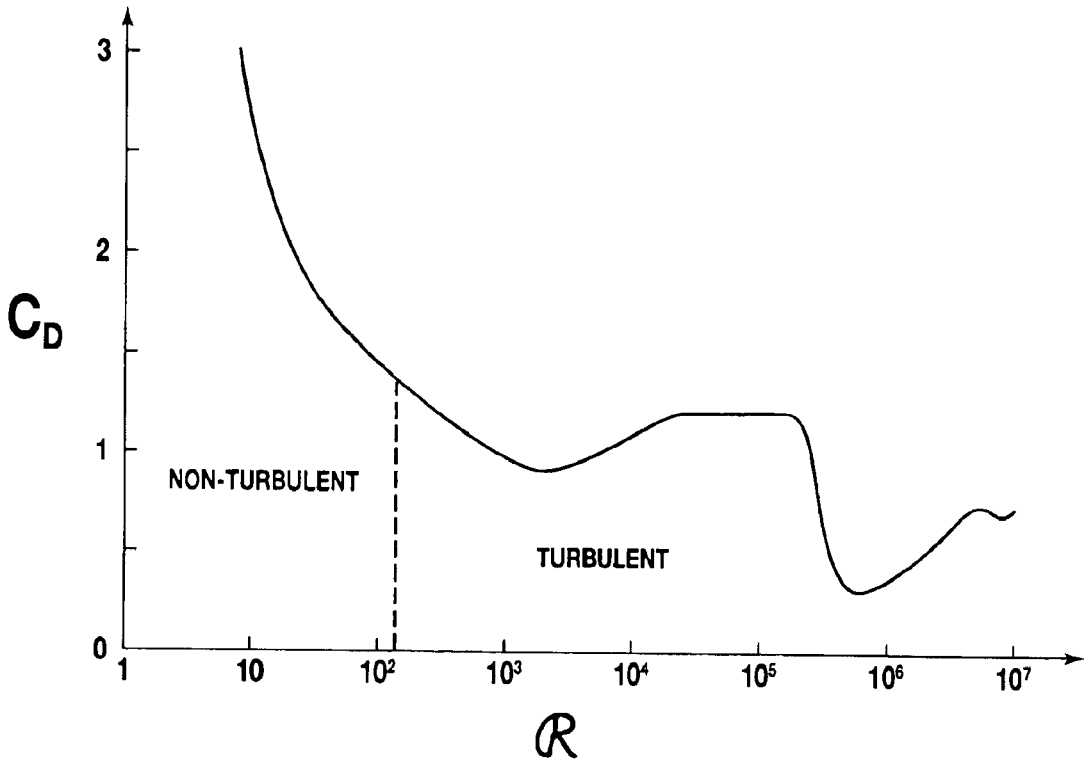
FIG. 9 (PRIOR ART)
FIG. 9 provides a plot of drag coefficient versus Reynolds number for a cylinder in linear motion through a liquid in a direction perpendicular to the axis of cylindrical symmetry of the cylinder.

Although the bore region (632) of the bob (611) rotates through the internal liquid (660) and the bore region (632) is not cylindrical, it is useful to consider the resistance to motion of a cylinder in linear motion through a liquid in a direction perpendicular to the axis of cylindrical symmetry since that case has been extensively studied. Emperically, it has been found that for a cylinder having a diameter D and a length l, the dimensionless drag coefficient $C_D$ given by $$C_D=(2F_D/\rho V^2 Dl) \tag{2.7}$$

behaves as a function of Reynolds number $R_e$ as plotted in FIG. 9. It should be noted that the Renolds number $R_e$ is plotted along the horizontal axis on a logarithmic scale. The divergence in the drag coefficient $C_D$ shown in FIG. 9 as the Reynolds number $R_e$ goes to zero is due to the fact that the drag force $F_D$ for low Reynolds numbers $R_e$ is proportional to the first power of velocity V. Since the drag coefficient $C_D$ is roughly unity for larger Reynolds numbers $R_e$ over three orders of magnitude (i.e., from $10^2$ to $10^5$), the drag force $F_D$ for Reynolds numbers $R_e$ within that range is roughly proportional to the square of the velocity V. As can be seen from FIG. 9, the magnitude of the drag coefficient $C_D$ drops sharply at a Reynolds number $R_e$ of about $2\times10^5$. This transition is termed the drag crisis. The drag crisis can be induced at a reduced Reynolds number $R_e$ by roughening the surface of the cylinder so that the boundary layer of flow next to the surface of the cylinder becomes turbulent at a lower Reynolds number $R_e$. (The drag crises is commonly taken advantage of on aircraft wings by affixing tiny vertical fins to the upper side of the wings to induce turbulence in the boundary layer and thereby lower the drag force $F_D$.) Therefore according to the present invention, surfaces (654) on the inside of the bladder (650) adjacent to the mouths (634) of the bore region (632) have a rough texture to induce turbulence in the boundary layer and thereby lower the drag force $F_D$.

The Reynolds number $R_e$ has a low value at the beginning of the string pass since the rotational velocity of the middle bob (611) is initially zero. For the sake of obtaining rough order-of-magnitude estimates it will be assumed that the angular velocity ω of the middle bob (611) behaves approximately as $\omega=15\ \pi^2 \sin(30\pi t)$ during the 180° string pass rotation from t=0 to $t=1/30^{th}$ of a second. Given this approximation, the flow becomes turbulent early in the 180° string pass rotation. In particular, within about $2\times10^{-5}$ seconds the Reynolds number $R_e$ reaches approximately $10^2$ and the flow becomes turbulent.

Figure 4A:
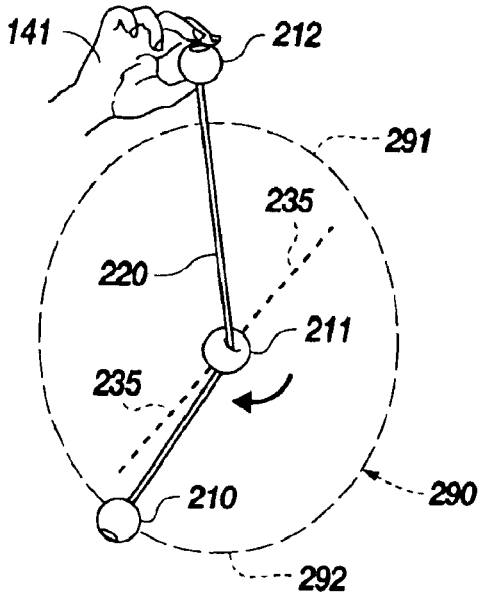
FIG. 4A (PRIOR ART)
FIGS. 4A–4D depict a first mode of rotation of the middle bob about its center as the orbiting outer bob passes the top of its orbit.
Figure 4B:
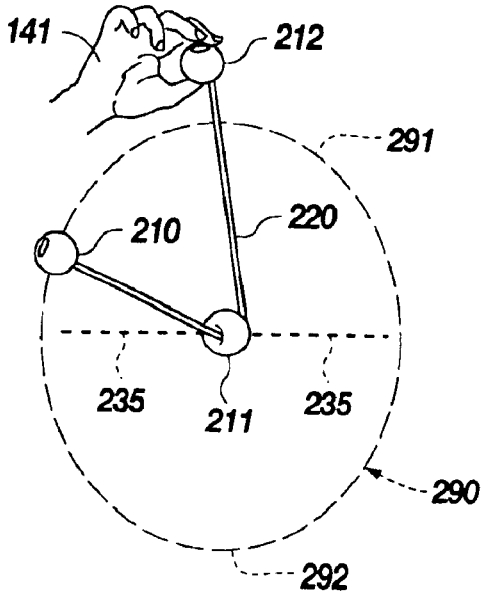
FIG. 4B (PRIOR ART)
Figure 4C:
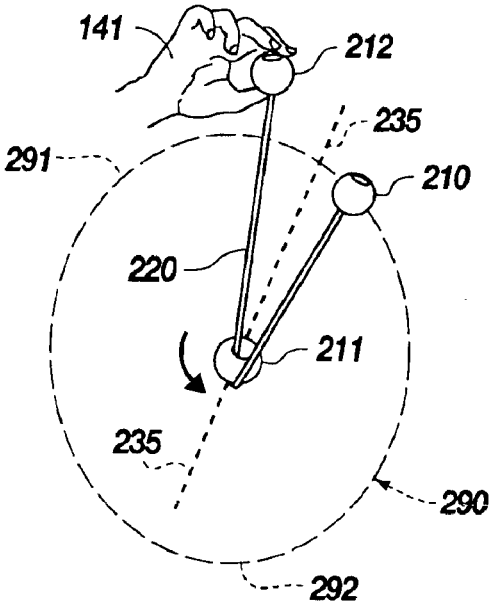
FIG. 4C (PRIOR ART)
Figure 4D:
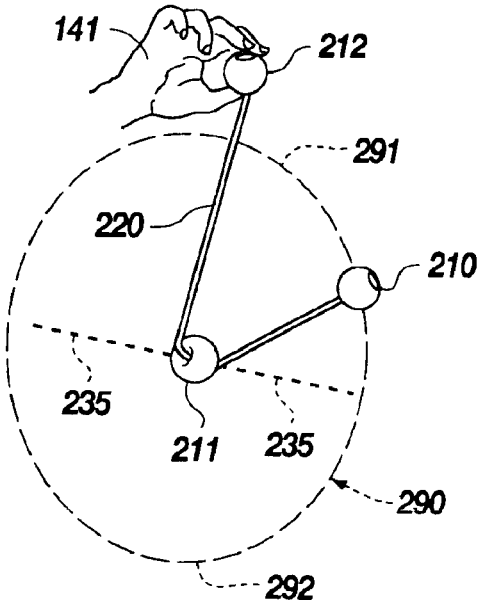
FIG. 4D (PRIOR ART)
Figure 5A:
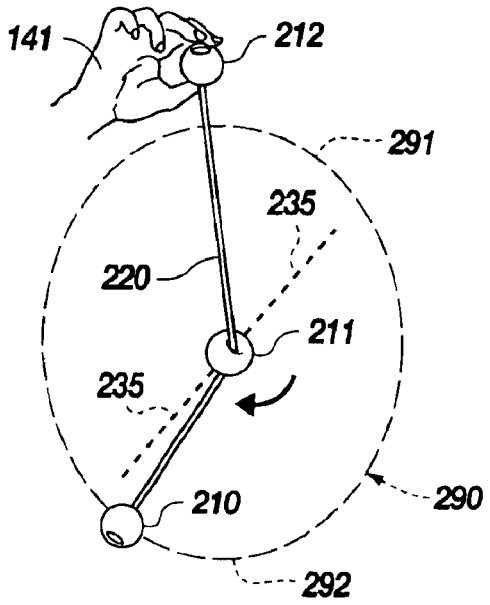
FIG. 5A (PRIOR ART)
FIGS. 5A–5D depict a second mode of rotation of the middle bob about its center as the orbiting outer bob passes the top of its orbit.
Figure 5B:
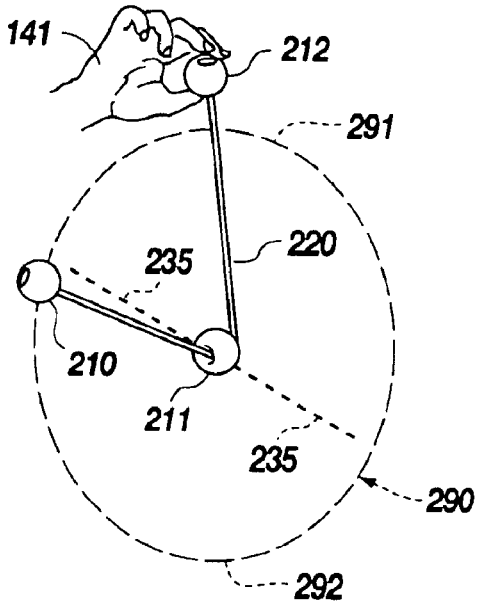
FIG. 5B (PRIOR ART)
Figure 5C:
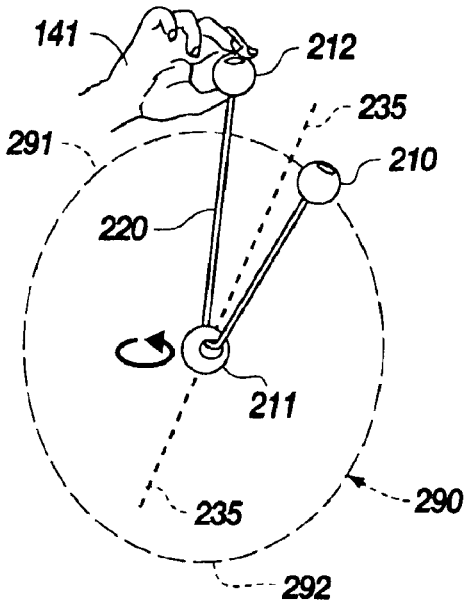
FIG. 5C (PRIOR ART)
Figure 5D:
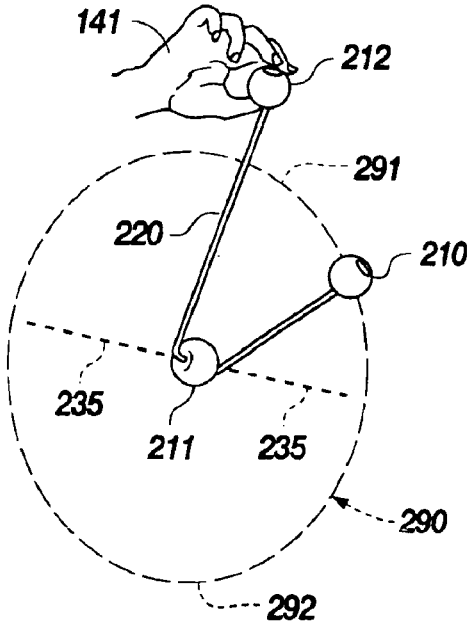
FIG. 5D (PRIOR ART)

It should be noted that the point in the motion of the middle bob (211) during the string pass that is most critical is when the bore axis (235) of the middle bob (211) is still pointing towards the side of the orbit (290) from which the orbiting outer bob (210) just came (i.e., the side of the orbit (290) where the orbiting outer bob (210) was moving upwards) as the outer bob (210) begins its descent, as is shown in FIGS. 4B and 5B. Substantially the same motion of the middle bob (611) occurs with the liquid-containing bobs version of the toy (600). Although the tension of the string (220) is finite at this point in the motion, the torque required to rotate the middle bob (211) through a rotation in the horizontal plane is small due to the combination of two small-angle components of the string tension. Firstly, while the orbiting outer bob (210) is near the apex of its orbit (290), the tension of the string (220) provides forces which are mostly vertical, rather than horizontal. Secondly, because the bore axis (235) is essentially in the plane of the orbit (290), what component of string tension there is in the horizontal plane acts on the middle bob (211) with only a small offset from the plane of the orbit (290), and therefore provides only a small torque. (In this discussion it should be noted that because of the finite width of the orbiting outer bob (210), the string (220) from the held bob (212) to the middle bob (211) is not generally co-planar with the string (220) from the middle bob (211) to the orbiting outer bob (210), so the "plane of the orbit (290)" is somewhat crudely defined.)

It is important to note that regardless of exactly when the transition from non-turbulence to turbulence occurs during the 180° string pass rotation, at the beginning of the 180° string pass rotation the angular velocity ω is low, and therefore the drag force $F_D$ is low, as is shown in FIG. 9. This provides the important advantage according to the present invention that because the drag force $F_D$ is low, the middle bob (611) is maximally responsive to the torque Γ provided by the string (220) at the crucial point when the 180° string pass rotation of the middle bob (611) is beginning.

However, in speaking of drag force $F_D$ it should be noted that the unspoken assumption is that either the velocity V is constant, or that changes in the velocity V do not have a substantial effect on the forces produced by the liquid (660). However, more generally the drag force $F_D$ is equal to the sum of a velocity drag $F_V$ and an acceleration drag $F_A$. For instance, at near-zero velocity V the resistance to the rotational motion is dominated by the resistance to the rotational acceleration $\dot{\omega}$. The inertial resistance $F_A$ to an acceleration A of an object through the liquid (660) is equal to the acceleration A in free space of an object of the same volume which has a density equal to the density of the liquid (660).

Figure 8A:
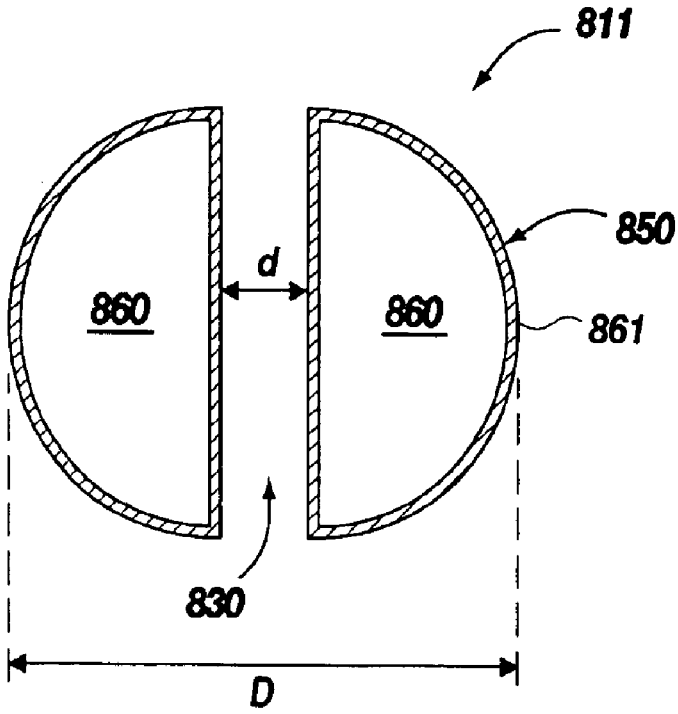
FIG. 8A shows a cross-sectional view of a first simplified-construction bob.

To facilitate the mathematical portions of the presentation of the present specification, it is useful to consider the simplified-construction bob (811) shown in the cross-sectional view of FIG. 8A which has a diameter D of 4.0 cm, and a bore region (830) which is cylindrical with a diameter d of 1.5 cm. Assuming, as above, that the angular velocity ω goes as $$\omega=15\,\pi^2 \sin(30\,\pi t) \tag{2.8}$$

during the 180° string pass rotation of the middle bob (811) from t=0 to t=1/30$^{th}$ of a second, and assuming that the drag from the rotational motion of each segment of the bore region (830) is roughly equal to the drag produced by linear motion, the acceleration drag $F_A$ of the bore region (830) for larger rotational velocities is $$\begin{aligned} F_A &\approx \frac{1}{2}\rho\pi d^2\dot{\omega}\int_0^{D/2} x\,dx \\ &= \frac{1}{8}\rho\pi d^2\dot{\omega}D^2 \\ &= \frac{225}{4}\rho\pi^4 d^2 D^2\cos(30\pi t), \end{aligned} \tag{2.9a}$$

or $$F_A \approx 2\times10^5 \cos(30\,\pi t) \text{ dynes}, \tag{2.9b}$$

where t is the time in seconds. In contrast, the velocity drag $F_V$ begins at t=0 with a value of zero and based on equation (2.7) goes as $$\begin{aligned} F_V &\approx \frac{1}{2}\rho d\omega^2\int_0^{D/2} x^2\,dx \\ &= \frac{1}{48}\rho d\omega^2 D^3 \\ &= \frac{225}{48}\rho\pi^4 dD^3\sin^2(30\pi t), \end{aligned} \tag{2.10a}$$

or $$F_V \approx 4.3\times10^4 \sin^2(30\,\pi t) \text{ dynes}, \tag{2.10b}$$

where t is the time in seconds, and the drag coefficient $C_D$ is taken to have a value of roughly unity. A comparison of equations (2.9b) and (2.10b) shows that for this simplified construction, the acceleration drag $F_A$ has a maximum value which is considerably larger than the maximum value of the velocity drag $F_V$. And, as discussed above, the acceleration drag $F_A$ has its maximum value at the crucial point when the string pass is beginning.

Figure 8B:
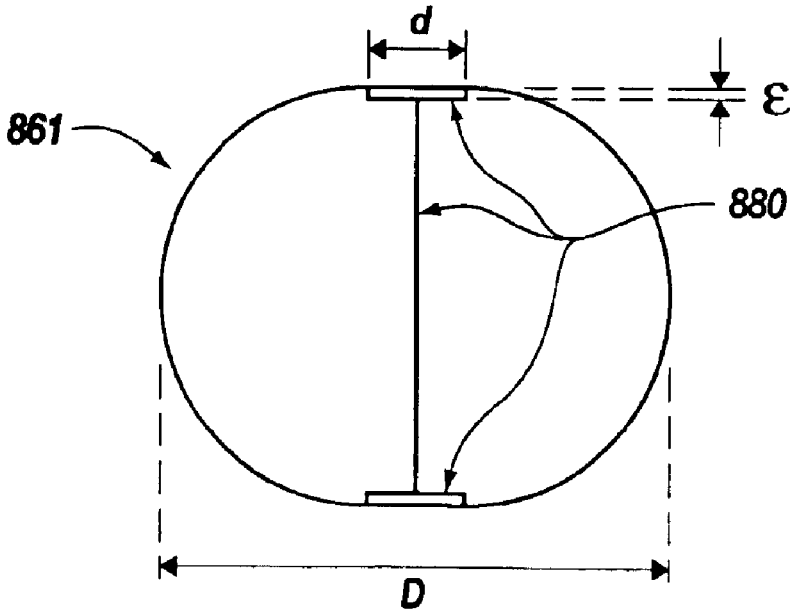
FIG. 8B shows a cross-sectional view of a second simplified-construction bob.

It is also illustrative to consider a second simplified-construction bob (861) shown in FIG. 8B which has a diameter D of 4.0 cm, and a bore region (880) which is infinitely narrow until it reaches the mouth (884) where it widens to a cylindrical portion of diameter d=1.5 cm and thickness ε=0.2 cm. Again assuming that the angular velocity ω goes as in equation (2.8), and assuming that the drag from the rotational motion of each segment of the bore region (830) is roughly equal to the drag produced by linear motion, the acceleration drag $F_A$ goes as $$\begin{aligned} F_A &\approx \frac{1}{2}\rho\pi d^2\dot{\omega}\int_{D/2-\varepsilon}^{D/2} x\,dx \\ &= \frac{1}{2}\rho\pi d^2\dot{\omega}x^2\,\Big|_{D/2-\varepsilon}^{D/2} \\ &\approx 225\rho\pi^4 d^2 D\varepsilon\cos(30\pi t), \end{aligned} \tag{2.11a}$$

or $$F_A \approx 4\times10^4 \cos(30\,\pi t) \text{ dynes}, \tag{2.11b}$$

where t is the time in seconds. In contrast, the velocity drag $F_V$ for the simplified-construction bob (861) of FIG. 8B begins at t=0 with a value of zero and based on equation (2.7) for larger rotational velocities goes as $$\begin{aligned} F_V &\approx \frac{1}{2}\rho\, d\omega^2\int_{D/2-\varepsilon}^{D/2} x^2 dx \\ &= \frac{1}{6}\rho d\omega^2 x^3\,\Big|_{D/2-\varepsilon}^{D/2} \\ &= \frac{225}{2}\rho\pi^4 dD^2\varepsilon\sin^2(30\pi t), \end{aligned} \tag{2.12a}$$

or $$F_V \approx 5\times10^4 \sin^2(30\,\pi t) \text{ dynes}, \tag{2.12b}$$

where t is the time in seconds. A comparison of equations (2.11b) and (2.12b) shows that for this simplified construction, the acceleration drag $F_A$ has a maximum value which is somewhat smaller than the maximum value of the velocity drag $F_V$.

Therefore, according to the present invention the contours of the middle bob (611), and particularly the contours of the throughbore (631) and bore region (632), are designed to minimize the acceleration drag $F_A$ and velocity drag $F_V$ while maximizing the torque Γ provided by the string (620). According to the present invention, the contours of the throughbore (631) and bore region (632) are determined as a compromise between competing requirements. To maximize the torque Γ produced by the string (220) at the beginning of the string pass, the throughbore (631) needs to be wide, particularly at the mouth (634) of the throughbore (631). However, to minimize the drag $F_D$ produced as the bore region (632) moves through the liquid (660), the bore region (632) needs to be narrow, particularly at the ends of the bore region (632). According to the present invention, both needs are met to a large extent by keeping the throughbore (631) and bore region (632) fairly straight and narrow near the midpoint (685) of the throughbore (631), and flairing the throughbore (631) and bore region (632) outwards at the ends (634). According to the preferred embodiment of the present invention, the ratio of the width of the mouth (634) of the throughbore (631) to the width of the bore at its midpoint (685) is greater than 2, more preferably greater than 3, still more preferably greater than 4, still more preferably greater than 5, even more preferably greater than 6, and still more preferably greater than 8. Furthermore, according to the present invention, the width of the mouth (634) of the throughbore (631) is 20% to 70% of the equatorial width of the bob (611), more preferably 30% to 60% of the equatorial width of the bob (611), more preferably 35% to 55% of the equatorial width of the bob (611), and still more preferably 40% to 50% of the equatorial width of the bob (611). Furthermore, according to the present invention, the width of the throughbore (631) at a depth of one-quarter of the length of the throughbore (631) is 10% to 40% of the width of the mouth (634) of the throughbore (631), more preferably 15% to 35% of the width of the mouth (634) of the throughbore (631), and still more preferably roughly 25% of the width of the mouth (634) of the throughbore (631).

As the orbiting outer bob (610) reaches the bottom of its orbit (690), the tension in the string (620) reaches a maximum. The suddenness of the increase in tension is dependent on the rapidity with which the middle bob (611) completes its 180° string pass rotation. Empirically, it has been found that increasing the viscosity $\nu$ of the liquid above the 0.01 poise value of water reduces the suddenness with which the string tension increases as the orbiting outer bob (610) reaches the bottom of its orbit (690), thereby increasing the smoothness of operation at this point in the orbit (690). However, it is important to note that since the rotation of the middle bob (611) is predominantly influenced by the acceleration drag $F_A$ rather than the velocity drag $F_V$ at the beginning of the 180° string pass rotation, if the viscosity $\nu$ is increased too much then the rotational velocity $\omega$ at the beginning of the 180° string pass rotation will be slowed to an extent that the string (620) will tangle around the middle bob (611) during the string pass. Therefore, according to the present invention the viscosity $\nu$ has an intermediate value which is (i) low enough that the dynamic moment of inertia $I^*$ at the beginning of the string pass is small enough that the string (620) does not tangle about the middle bob (611), yet (ii) the viscosity $\nu$ is large enough that the rotation of the middle bob (611) during the 180° string pass rotation is slowed so as to increase the smoothness of operation as the orbiting outer bob (610) reaches the bottom of its orbit (690). (In this embodiment of the present invention, the interior of the bladder (650) does not have roughened regions (654) near the mouths (634) of the throughbore (631).) According to the present invention the viscosity $\nu$ has a value preferably between 10 and 200 centipoise, more preferably between 25 and 150 centipoise, still more preferably between 50 and 120 centipoise, and more preferably between 60 and 90 centipoise. For reference, Table 1 below provides the viscosities in centipoises of a number of common liquids at room temperature. According to this preferred embodiment of the present invention, the liquid (660) in the bladder (650) is cotton seed oil.

TABLE 1

| Viscosities of common liquids at room temperature (centipoise) | |
|---|---|
| Methyl alcohol | 0.6 |
| Water | 1.0 |
| Cotton seed oil | 70 |
| Soya bean oil | 70 |
| Light machine oil | 113 |
| Glycerin | 1490 |

According to an alternate preferred embodiment of the present invention, the appearance of the bobs (610), (611) and (612) can be enhanced by making the bladder (650) out of a transparent material and including shiny particles (not shown) in the liquid (660) having a density near the density $\rho$ of the liquid (660). Because the particles have a near-zero buoyancy, they will swirl around with the liquid (660) for an extended period of time when a bob (610), (611) and (612) is rotated to provide an attractive appearance. Alternatively, the appearance of the bobs (610), (611) and (612) can be enhanced by making the bladder (650) out of a transparent material and including two or more immiscible low-viscosity liquids of different colors (not shown)—where according to the lexography of the present specification the term "color" refers to light transmission and/or reflection properties, and transparency is considered a possible "color"—and near-equal densities $\rho_1 \cong \rho_2 \cong \rho_3 \cong \ldots$ If the liquids have a low liquid-to-liquid surface tension, they will swirl together for an extended period of time when the bob (610), (611) and (612) is rotated to provide an attractive appearance.

Thus, it will be seen that the improvements presented herein are consistent with the objects of the invention for a swinging bob toy described above. While the above description contains many specificities, these should not be construed as limitations on the scope of the invention, but rather as exemplifications of preferred embodiments thereof. Many other variations are within the scope of the present invention. For example: the swinging bob toy may have only two bobs, i.e., a sliding bob and an end bob, so that the end of the string opposite the end occupied by the end bob is held during operation; one or both end bob may have a different construction from that of the middle bob; a bob may have a non-cylindrically symmetric weight distribution; the exterior surface of a bob may not be substantially spherical; the exterior surface of a bob may not have cylindrical symmetry; the bore through a bob may not have cylindrical symmetry; a bob may include a central, high-density weight; one or more of the bobs may not have a liquid-containing bladder; the bladder may not be made of a flexible material; the sheath and bladder may both be made of transparent materials; there may not be a sheath in the bore of the bladder; the bladder may not be completely filled with the liquid; the bladder may have multiple interior compartments, and the interior compartments may contain a variety of fluids, or some of the interior compartments may be empty; the bladder may not extend all the way to the central region of the sheath, the ends of the sheath, or the equator of the bob; the sheath may act as a portion of the bladder; portions of the interior of the bladder may not be roughened to induce turbulence and promote the drag crises; the movable component(s) of the bob need not be liquid and need not be in the interior of the bob, and may for instance be rubbery filaments, or weights mounted on springs; the static moment of inertia of the non-movable components need not be substantially smaller than the non-dynamic moment of inertia of the movable components; the dynamic moment of inertia of the movable components need not be substantially smaller than the non-dynamic moment of inertia of the movable components; the mass of the non-movable components need not be substantially smaller than the mass of the movable components; the movable components may have a stiffness/flexibility to mimic the effects of an increased-viscosity liquid; the liquid may not include an anti-freezing agent; the bore may have a flare other than as described; etc. It should also be noted that in the present specification "liquid" is considered to be synonymous with "fluid."

Furthermore, the description of the physical principles underlying the operation and performance of the present invention are described as presently understood, but may not be accurate and are not intended to be limiting. It should also be understood that these physical descriptions may include approximations, simplifications and assumptions. For instance: the rotation of a middle bob during the string pass may be more simple or more complicated than described, may differ from what is described, or its behavior may have physical causes or affects other than what is described; fluid flows may differ from those described; the dimensionless ratio reflecting the goodness of operation may be other than that defined; the dynamic moment of inertia may be determined other than as described; the drag of the bore through the liquid may not be well-approximated by a sum or integral of small sections of the bore in linear motion through a liquid; the viscosity of the liquid or liquid may affect the motion of the middle bob other than as described; the rotation of the middle bob may not be well-described by equation (2.8); the drag may not be well-described as the sum of a velocity drag and an acceleration drag; the acceleration drag may be dependent on acceleration or other variables other than as described; the velocity drag may be dependent on velocity or other variables other than as described; etc.

Accordingly, it is intended that the scope of the invention is determined not by the embodiments illustrated or the physical analyses motivating the illustrated embodiments, but, rather, by the appended claims and their legal equivalents.

What is claimed is:

1. A swinging bob toy comprising:

a flexible, elongated tethering means;

a first end bob; and a sliding bob having a throughbore along a polar axis normal to an equator in an equatorial plane, said throughbore having a first mouth at a first end thereof and a second mouth at a second end thereof, said tethering means passing through said throughbore of said sliding bob so that said sliding bob is slidable along said tethering means, said first end bob being constrained on said tethering means between said sliding bob and a first end of said tethering means, and said sliding bob having a bladder which encircles said throughbore and contains a liquid.

2. The swinging bob toy of claim 1 further comprising a second end bob constrained on said tethering means between said sliding bob and a second end of said tethering means.

3. The swinging bob toy of claim 1 wherein said bladder has a roughened interior surface adjacent said first mouth of said throughbore which induces turbulence in a boundary layer of said liquid at a reduced Reynolds number.

4. The swinging bob toy of claim 1 wherein said liquid substantially fills said bladder.

5. The swinging bob toy of claim 1 wherein said liquid does not fill said bladder.

6. The swinging bob toy of claim 1 wherein a portion of said bladder extends from said throughbore to said equator of said sliding bob.

7. The swinging bob toy of claim 1 wherein a portion of said bladder extends from said first mouth to said second mouth of said throughbore.

8. The swinging bob toy of claim 1 wherein said bladder extends from said throughbore to said equator of said sliding bob, and from said first mouth to said second mouth of said throughbore.

9. The swinging bob toy of claim 1 wherein said bladder includes a rigid sheath along said throughbore of said sliding bob and a flexible surface along said equator of said sliding bob.

10. The swinging bob toy of claim 9 wherein said flexible surface extends from said first mouth of said throughbore to said second mouth of said throughbore.

11. The swinging bob toy of claim 1 wherein said bladder is transparent.

12. The swinging bob toy of claim 11 wherein said liquid includes solid particles having a solid density roughly equal to a liquid density of said liquid.

13. The swinging bob toy of claim 11 wherein said liquid includes a first fluid of a first color and a second fluid of a second color which is immiscible with said first fluid.

14. The swinging bob toy of claim 13 wherein said first color is transparent.

15. The swinging bob toy of claim 1 wherein said liquid is water.

16. The swinging bob toy of claim 1 wherein said liquid has a viscosity between 10 and 200 centipoise.

17. The swinging bob toy of claim 1 wherein said liquid has a viscosity between 25 and 150 centipoise.

18. The swinging bob toy of claim 1 wherein said liquid has a viscosity between 60 and 90 centipoise.

19. The swinging bob toy of claim 1 wherein a first width of said first mouth is 35% to 55% of a second width of said equator of said sliding bob, and a third width of said throughbore at a depth of one-quarter of a length of said throughbore is 15% to 35% of said first width.

20. A swinging bob toy comprising:

a flexible, elongated tethering means;

a first end bob; and a sliding bob having a throughbore along a polar axis normal to an equatorial plane, said throughbore having a first mouth at a first end thereof and a second mouth at a second end thereof, said tethering means passing through said throughbore of said sliding bob so that said sliding bob is slidable along said tethering means, said first end bob being constrained on said tethering means between said sliding bob and a first end of said tethering means, and said sliding bob having movable components and non-movable components, said movable components having a movable mass, and said non-movable components having a non-movable mass which is less than said movable mass.

21. The swinging bob toy of claim 20 wherein said non-movable mass is less than 80% of said movable mass.

22. The swinging bob toy of claim 20 wherein said non-movable mass is less than 60% of said movable mass.

23. The swinging bob toy of claim 20 wherein said non-movable mass is less than 40% of said movable mass.

24. The swinging bob toy of claim 20 wherein said non-movable mass is less than 20% of said movable mass.

25. A swinging bob toy comprising:

a flexible, elongated tethering means;

a first end bob; and a sliding bob having a throughbore along a polar axis normal to an equatorial plane, said throughbore having a first mouth at a first end thereof and a second mouth at a second end thereof, said tethering means passing through said throughbore of said sliding bob so that said sliding bob is slidable along said tethering means, said first end bob being constrained on said tethering means between said sliding bob and a first end of said tethering means, said sliding bob having movable components and non-movable components, said movable components having a motion-dependent dynamic moment of inertia and a non-dynamic moment of inertia reflecting a moment of inertia when said movable components are frozen in place relative to said non-movable components, and said non-movable components have a static moment of inertia, and where a first sum of said dynamic moment of inertia and said static moment of inertia is less than a second sum of said non-dynamic moment of inertia and said static moment of inertia.

26. The swinging bob toy of claim 25 wherein said first sum is less than 80% of said second sum.

27. The swinging bob toy of claim 25 wherein said first sum is less than 80% of said second sum.

28. The swinging bob toy of claim 25 wherein said first sum is less than 60% of said second sum.

29. The swinging bob toy of claim 25 wherein said first sum is less than 40% of said second sum.

30. The swinging bob toy of claim 25 wherein said first sum is less than 20% of said second sum.

* * * * *